United States Patent [19]

Sindelar

[11] 4,344,287

[45] Aug. 17, 1982

[54] VOLUME COMPENSATION FOR HYDRAULIC CIRCUITS

[75] Inventor: Ernest C. Sindelar, Aurora, Ill.

[73] Assignee: Caterpillar Tractor Co., Peoria, Ill.

[21] Appl. No.: 182,293

[22] Filed: Aug. 28, 1980

Related U.S. Application Data

[63] Continuation-in-part of Ser. No. 99,135, filed Aug. 23, 1979 as PCT/US79/00645, § 102(e) date Aug. 23, 1979, § 371 date Aug. 23, 1979, published Mar. 5, 1981 as WO81/00599, now abandoned.

[51] Int. Cl.[3] ..... F15B 7/10

[52] U.S. Cl. ..... 60/572; 91/442; 91/460

[58] Field of Search ..... 60/571, 572, 573, 583, 60/592, 591; 91/460, 442; 251/57; 414/715

[56] References Cited

U.S. PATENT DOCUMENTS

| | | | |
|---|---|---|---|
| 2,008,760 | 7/1935 | Jäderblom | 91/442 |
| 2,368,659 | 2/1945 | Heineck | 60/573 |
| 2,383,180 | 8/1945 | Ellinwood | 60/572 |
| 2,417,278 | 3/1947 | Van Der Werff | 60/573 |
| 2,468,489 | 4/1949 | D'Arcey | 60/572 |
| 2,474,681 | 6/1949 | Lane | 91/442 |
| 2,540,879 | 2/1951 | Hebel | 60/572 |
| 3,272,280 | 9/1966 | Schuetz | 414/715 |
| 3,304,953 | 2/1967 | Wickline | 137/596.12 |
| 3,340,897 | 9/1967 | Nevulis | 137/625.6 |
| 3,766,944 | 10/1973 | Distler | 137/625.6 |
| 3,857,404 | 12/1974 | Johnson | 91/420 |
| 4,030,560 | 6/1977 | Parquet | 60/571 |
| 4,085,920 | 4/1978 | Waudoit | 251/57 |

OTHER PUBLICATIONS

Sperry Hydraulic–Sperry Controls, Inc.
Hydronic Remote Control System–Hydronic Corporation.

*Primary Examiner*—Abraham Hershkovitz
*Attorney, Agent, or Firm*—William B. Heming

[57] ABSTRACT

A hydraulic circuit (32), for example, remotely controls a work element (14) and contains first apparatus (34), such as a master cylinder (42), which passes a fluid pressure signal through a fluid pathway (38, 40) in response to an input signal. Second apparatus (36), such as a slave cylinder (44), correspondingly delivers an output signal for controlling the work element (14). Temperature variation can cause fluid volume changes which disrupt synchronized operation of the master and slave cylinders (42, 44). Third apparatus (74) positions the fluid pathways (38, 40) in fluid communication with a tank (28) in the absence of the fluid signal. If the signal passes through one pathway (38, 40), that pathway (38, 40) is automatically blocked from communication with the tank (28). Thus, when the fluid signal is absent from the fluid pathways (38, 40), volume compensation occurs because of dilution of the fluid in the circuit (32) with the tank fluid. This substantially overcomes volumetric problems from fluid temperature changes.

7 Claims, 3 Drawing Figures

VOLUME COMPENSATION FOR HYDRAULIC CIRCUITS

CROSS REFERENCE TO RELATED APPLICATIONS

This application is a continuation-in-part of application Ser. No. 099,135, filed Aug. 23, 1979, as PCT/US79/00645, § 102(e) date Aug. 23, 1979, § 371 date Aug. 23, 1979, published Mar. 5, 1981 as WO81/00599 by Ernest C. Sindelar, now abandoned.

DESCRIPTION

1. Technical Field

The invention relates to hydraulic circuits which have compensation for volume changes due to temperature variations. More particularly, the invention relates to closed hydraulic circuits, such as master slave cylinder circuits, which provide a control valve for volume compensation due to temperature variations.

2. Background Art

In a hydraulic circuit, particularly a closed hydraulic circuit, it is desirable to provide apparatus to compensate for volume changes owing to temperature variations in the circuit.

For example, in closed hydraulic circuits, such as are typically represented by master-slave cylinder circuits, the master and slave cylinders are generally identical and are connected by two fluid lines. Input by way of a control handle or the like moves a piston in the master cylinder to build up pressure and send a fluid signal through one of the lines to one side of a piston in the slave cylinder. The fluid signal causes a corresponding and synchronized piston movement in the slave cylinder which provides an output to a control valve for operation of an associated hydraulic cylinder. The other of the hydraulic lines connecting the slave and master cylinders is used as a return line to the master cylinder for displaced fluid from the other side of the piston in the slave cylinder.

If temperature changes occur after the master and slave cylinders are synchronized, fluid volume changes in the circuit will cause a loss of synchronization between the slave and master cylinders. Where this happens, the slave and master cylinders will lose their preset corresponding movements and movement of the work element will not correspond consistently to the same input at the master cylinder. This is best seen with reference to the starting or zero point of the master cylinder. At the starting point, the piston in the cylinder is generally centered and resulting movement of the control handle in a certain direction moves the piston to force fluid through one of the fluid pathways to the slave cylinder. This results in a corresponding movement of the slave cylinder piston for directing the output on the slave cylinder shaft. Correspondingly, fluid on the other side of the piston of the slave cylinder is forced back into the master cylinder to complete the closed circuit. It will be readily seen, therefore, that any temperature change in the master-slave cylinder circuit can cause a volumetric change in fluid which will change the synchronized relationship, particularly with respect to the starting point of the master cylinder piston. Thus, for example, after use, the piston of the master cylinder can return to a different starting point which changes the synchronized movement of the slave and master cylinders as originally set.

In certain applications, such as, for example, an articulated vehicle, the master and slave cylinders are commonly spaced at great distances one from the other which increases the possibilities for temperature variations. Further, this requires different lengths of hose to stretch between the master and slave cylinders and it also requires flexible hose to cross the articulated joint of the work vehicle. For volume compensation in such instances, it is desirable to minimize the number of parts in the hydraulic circuit and to provide apparatus of convenient size for placing in particular locations of the vehicle. This is important to protect the circuitry from the environment of the work vehicle.

Previously, in some circuits an additional synchronizing position has been provided in the master cylinder controls. The synchronizing position can be engaged by the operator to compensate for any temperature changes which result in volumetric changes in the system. Thus, movement of the controls by the operator will open a valve to either vent fluid or permit entry of fluid into the system to compensate for any volumetric changes. This system, however, results in a waste of time and labor owing to the fact that the operator must monitor the system and periodically make adjustments. Other systems have provided free-floating cylinders or pistons in the master cylinder to compensate for volumetric expansion and contraction. When loads are applied, automatic locking devices make the free-floating elements immovable in order to carry the load being applied in the cylinder. This system requires additional specialized components and may not be desirable for certain applications.

U.S. Pat. No. 3,766,944 which issued to Distler on Oct. 23, 1973, discloses one example of a servo or flow regulatory valve controlled by a master or pilot valve. Pressurizing one pilot member of the pilot valve actuates the flow regulatory valve in one direction of displacement with the other pilot member and return line remaining open to the tank.

Other circuits which are representative of master and slave valve controls are shown in the U.S. Patents described below. U.S. Pat. No. 4,085,920 which issued to Waudoit on Apr. 25, 1978, discloses a fluid operated main control valve and an adjustable servo valve for controlling the main valve. Fluid passes from a servo valve to the main control valve for controlling the operation of an associated hydraulic cylinder or the like. U.S. Pat. No. 3,857,404 which issued to Johnson on Dec. 31, 1974, discloses a lock valve assembly for controlling a hydraulic cylinder. The lock valve meters fluid flow from the cylinder so that initial movement of the cylinder is gradual and precise adjustments can be made in the operation of, for example, an implement associated with the cylinder. U.S. Pat. No. 3,304,953 which issued to Wickline on Feb. 21, 1967, and U.S. Pat. No. 3,340,897 which issued to Nevulis on Sept. 12, 1967, also disclose master and servo circuits.

The present invention is directed toward overcoming one or more of the problems as set forth above.

DISCLOSURE OF INVENTION

In one aspect of the present invention, a hydraulic circuit has a tank and first and second fluid pathways. Said first and second fluid pathways extend between and are associated with first means, which receives an input signal and passes a fluid pressure signal through one of said fluid pathways in response to said input signal, and second means which receives said fluid signal and automatically delivers an output signal corresponding to said input signal in response to the fluid signal. Third means is provided for automatically positioning both of the first and second fluid pathways in fluid communication with the tank in response to the fluid pathways being free from said fluid signal. Said third means also automatically blocks the one of said fluid pathways having said fluid signal from fluid communication with the tank.

For example, the first and second means can be a master and slave cylinder, respectively. The third means, such as a control valve, automatically, controllably provides fluid volume compensation in the fluid pathways not pressurized for transmitting a fluid pressure signal to substantially overcome problems associated with temperature variations in the circuit.

BEST MODE FOR CARRYING OUT THE INVENTION

Figure 1:
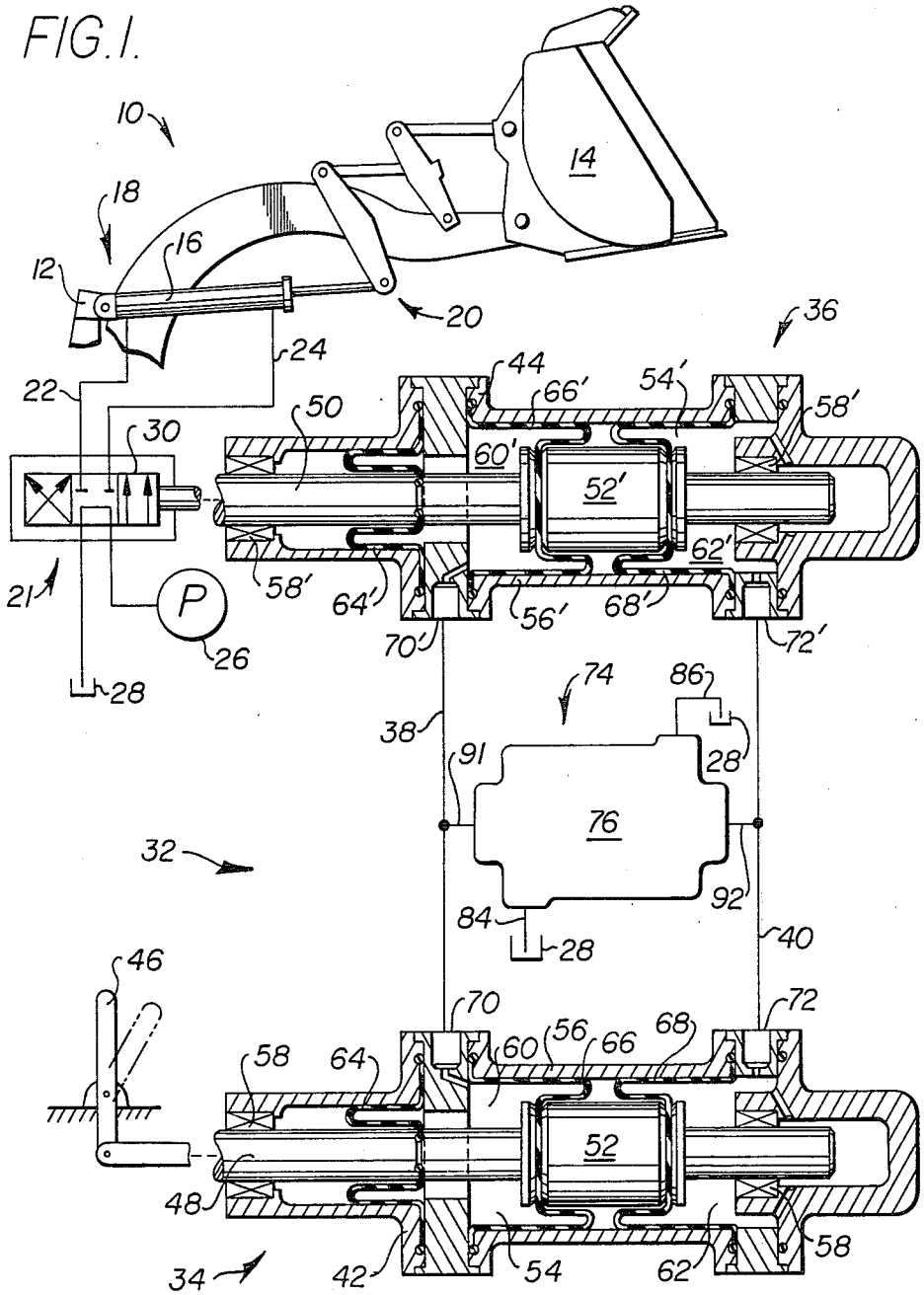
FIG. 1 is a diagrammatic view showing the location of the present invention within a typical environment represented by a master-slave hydraulic circuit used to control a work element on a work vehicle.

Referring to FIG. 1, a work vehicle 10 has a frame 12 and a work element 14 movably connected to said frame. A hydraulic cylinder 16 having first and second ends 18,20 is pivotally connected at the first end to the frame and at the second end to linkage controlling the work element. The work element is shown as the bucket 14 of the work vehicle. The work vehicle also has a control valve 21 and first and second work fluid pathways 22,24 positioned in fluid communication with said first and second ends of the hydraulic cylinder, respectively. Said work fluid pathways are controllably positionable in fluid communication with a pressurized fluid source 26 and a tank 28 of the work vehicle in response to moving a valve spool 30 in said control valve. Controllably moving the valve spool in the control valve directs fluid to one of the ends of the hydraulic cylinder to position the bucket as desired by the operator.

The work vehicle 10 also has a hydraulic circuit 32 associated with the control valve 21 and hydraulic cylinder 16 for controllably operating said hydraulic cylinder and positioning said work element 14. The hydraulic circuit includes first means 34, shown, for example, as a master cylinder, second means 36, shown, for example, as a slave cylinder, and first and second fluid pathways 38,40, shown, as hydraulic lines. The work fluid pathways extend between and are associated with said master and slave cylinders. The master cylinder is provided for receiving an input signal and controllably passing a predetermined fluid pressure signal through one of said fluid pathways in response to said input signal. The slave cylinder 44 is provided for receiving the fluid pressure signal in one of the fluid pathways and automatically controllably delivering an output signal corresponding to said input signal in response to the fluid signal. Said slave and master cylinders are shown of identical construction, but it should be understood that said cylinders can be of different configurations and further that said first and second means can be of other configurations other than slave and master cylinders, as is known in the art.

The input signal is provided to the master cylinder by a control handle 46 connected to a rod 48 of the master cylinder. Said control handle can be manually operated to position the bucket 14 at a desired location as will be hereinafter more fully described. Movement of the control handle and operation of the master cylinder 42 results in movement of a similar rod 50 of the slave cylinder which is connected to the valve spool 30 of the control valve. Movement of the rod of the slave cylinder delivers the output signal to the control valve which determines the positions of said valve and the flow of work fluid through the work fluid pathways 22,24 to the hydraulic cylinder 16.

Construction of the master cylinder 34 will now be provided in detail. For purposes of this disclosure, as above mentioned, the slave cylinder 36 is identical to said master cylinder and any description of the master cylinder will equally apply to the slave cylinder. Comparative slave cylinder elements relative to the master cylinder are given the same reference numerals, but with prime notations.

The master cylinder 34 has a piston 52 positioned on the rod 48 and in a chamber 54 of said cylinder. The chamber 54 is defined generally by a housing 56 of the master cylinder which is supported by bearings 58 about the rod 48. Said chamber is further divided into first and second chamber portions 60,62. The first chamber portion is defined by the housing diaphragm elements 64,66. The second chamber portion is defined by the housing and a diaphragm element 68. The master cylinder also has first and second fluid ports 70,72 which communicate with the first and second chamber portions, respectively. The first and second fluid pathways 38,40 extend from the first and second fluid ports 70,72 of the master cylinder to the related, comparable ports 70',72' of the slave cylinder.

As is known in the art, the master and slave cylinders form a closed hydraulic circuit which is initially synchronized and filled with fluid before operation thereof. Synchronization is accomplished by establishing a zero or starting point in the master cylinder and a comparable zero or starting point in the slave cylinder. Thus, the position of the control handle 46 is established relative to the desired direction of motion of the work element and position of hydraulic valve 21 and any movements of the control handle provide comparable, synchronized movement of the hydraulic valve.

Third means 74, such as the control valve 76, provides fluid volume change compensation in the hydraulic circuit 32 by automatically, controllably positioning both of said first and second fluid pathways 38,40 in fluid communication with the tank 28 in response to said fluid pathways being free from the fluid pressure signal. During operation of the hydraulic circuit 32, said control valve, in response to the fluid signal, automatically, controllably blocks the one of said fluid pathways having the fluid signal from fluid communication with the tank.

Figure 2:
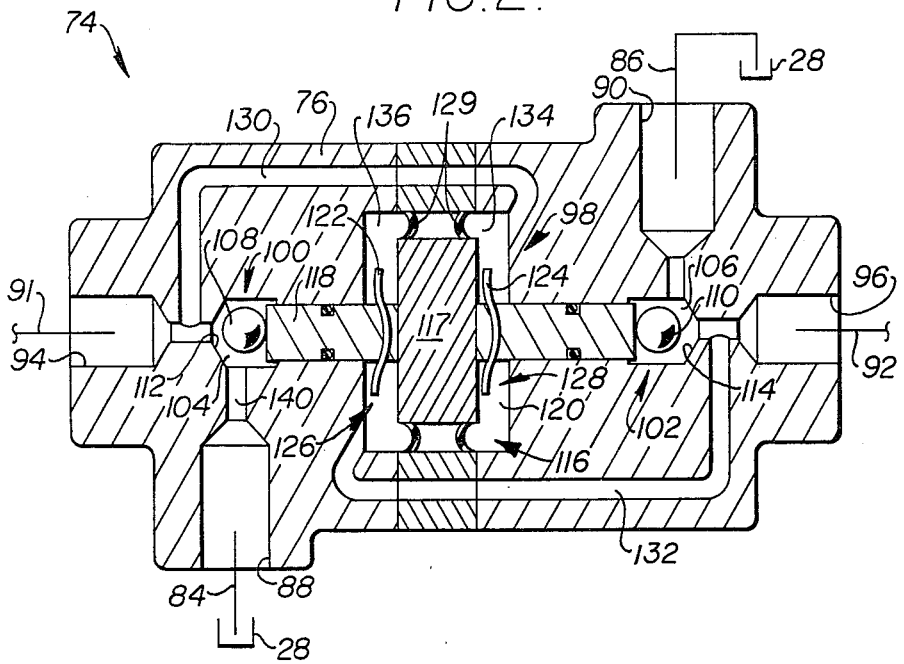
FIG. 2 is a diagrammatic, cross sectional view showing one embodiment of the present invention.
Figure 3:
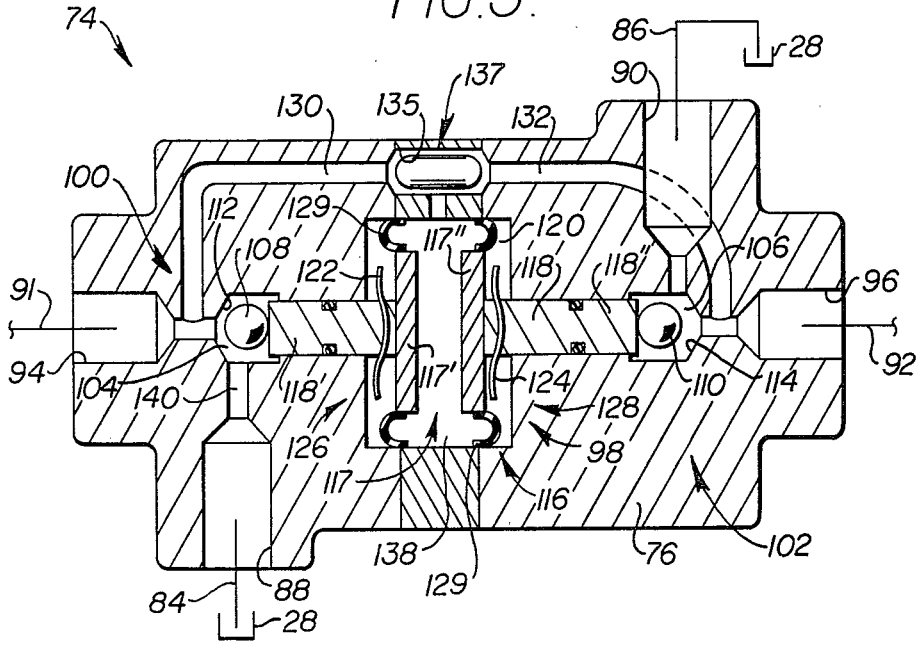
FIG. 3 is a diagrammatic, cross sectional view showing another embodiment of the present invention.

Referring particularly to FIGS. 2 and 3, the control valve 76 is in fluid communication with the first and second fluid pathways 38,40. Third and fourth fluid pathways 84,86 establish fluid communication of the control valve and the tank 28 through gravity fluid communication with the control valve through first and second ports 88,90, respectively, of said control valve. The control valve is in fluid communication with the first and second fluid pathways through first and second fluid supply pathways 91,92, which are positioned in fluid communication with the control valve through third and fourth ports 94,96, respectively.

The control valve 76 has flow control means 98, which includes a first check valve 100, for automatically, controllably blocking the first and third fluid pathways 38,84 from fluid communication with each other in response to passing the fluid signal in the first fluid pathway 38. A second check valve 102 automatically, controllably blocks fluid communication between the second and fourth fluid pathways 40,86 in response to passing the fluid signal in the second fluid pathway 40. The flow control means through said check valves also automatically, controllably positions the first and second fluid pathways 38,40 in fluid communication with the third and fourth fluid pathways 84,86, respectively, in response to the first and second fluid pathways being free from the fluid signal.

The first and second check valves 100,102 each have a chamber 104,106 and a ball 108,110 seatable against a seat 112,114 of the respective check valve. A piston assembly 116 has a piston 117 which is connected to a rod 118 extending into the chambers 104,106 of the check valves. The balls are shown freely positioned in the respective chambers, but they can also be connected to the ends of the rod. In the embodiment of FIG. 3, said piston 117 has first and second portions 117',117" connected to respective portions 118',118" of the rod 118. The piston assembly in both embodiments is positioned in a chamber 120 of the control valve and is normally centered at a neutral position, as is shown, by first and second springs 122,124, such as wave springs, positioned on opposite sides 126,128, respectively, of the piston 117. Diaphragms 129 are connected to the piston assembly and the body of the control valve and are flexibly movable with the piston assembly.

The control valve 76 includes first and second pilot pathways 130,132 in fluid communication with the chamber 120 and with the tank 28 through the third and fourth fluid pathways 84,86 respectively.

In the embodiment of FIG. 2, the pilot pathways 130,132 are shown as separate passageways in the control valve 76 extending from the ports 94,96, respectively, to first and second work portions 134,136, respectively, which are defined by the diaphragms 129 in the chamber 120 and positioned on respective opposite sides 126,128 of the piston. In the embodiment of FIG. 3, said pilot pathways are shown as passageways in the control valve which extend from said ports 94,96, respectively, to a common chamber 135 in which is positioned a shuttle check valve 137. The shuttle check valve directs fluid to a single work portion 138 of the chamber 120 regardless of which the fluid pathways 38,40 is pressurized. The shuttle check valve also allows communication of both fluid pathways 38,40 with the chamber work portion 138 when the first and second fluid pathways 38,40 are free from the fluid signal.

The first and third fluid pathways 38,84 and the second and fourth fluid pathways 40,86 are positionable in fluid communication with each other through the related one of the chambers 104,106 of the first and second check valves 100,102, respectively, and passageways in the valve body, such as the one identified by reference numeral 140 at the first and third pathways. The piston 117 is movable to locations sufficient for seating the related one of the balls 108,110 of the first and second check valves 100,102 in response to passing the fluid signal in said first and second fluid pathways 38,40 respectively.

It should be understood that the control valves can be of other configurations as is known in the art without departing from the invention. For example, the check valves 100,102 can utilize a ball in a chamber without the need for a piston to move the ball when desired. The ball is moved by the fluid pressure signal against a seat which blocks fluid flow past the seat. With the absence of the fluid signal, the ball would allow fluid flow to the tank by leaking fluid across a poorly fitting seating surface against which it would normally seat under reverse flow conditions.

INDUSTRIAL APPLICABILITY

In the operation of the hydraulic circuit 32, a fluid signal is initiated by movement of the control handle 46 to displace the piston 52 and pressurize one of the first and second chambers 60,62 of the master cylinder 42. This causes a fluid pressure rise in one of the chamber portions 60,62 and through the related one of the first and second fluid pathways 38,40. This pressure rise acts as the fluid pressure signal which enters the slave cylinder and causes a corresponding displacement of the piston 52' and corresponding translation of the rod 50 of said slave cylinder 44. Movement of the rod 50 provides an output signal resulting in movement of the valve spool 30 of the control valve 21 to actuate the hydraulic cylinder.

For example, initially, when the piston 52 of the master cylinder 42 is at the zero or starting position in the chamber 54 of said master cylinder, there is no pressure rise or fluid signal in the hydraulic circuit 32. Thus, the first and second fluid pathways 38,40 are free from a fluid signal and the balls 108,110 of the check valves 100,102 are loosely maintained at positions in their respective chambers 104,106 at which fluid can pass through said chambers. Fluid is free to pass from the first fluid pathway, for example, through the first supply pathway and into the port 94 of the control valve 76. From said port, the fluid passes past the ball 108 of the first check valve 100, into the passageway 140 and then to the port 88. From said port the fluid passes into the third pathway 84 and the tank 28. Similarly, fluid communicates with the tank from the second fluid pathway 40.

At the neutral postion, therefore, fluid in both the first and second fluid pathways 38,40 is in communication with the tank 28 and any temperature variations in the system which cause volume changes in the work fluid of the hydraulic circuit 32 will not effect the zero or starting point of the pistons 52,52' in the master and slave cylinders 42,44. This will be evident in that a change in volume which changes fluid pressure will be substantially, equally compensated on both sides of the pistons 52,52' of said cylinders owing to fluid in the circuit being diluted within the larger volume of fluid in the tank.

When a fluid signal is created in the hydraulic circuit 32 by movement of the control handle 46, the resultant fluid pressure rise established by movement of the piston 52 in the chamber 54 of the master cylinder 42 causes a similar rise through one of the first and second fluid pathways 38,40 to the slave cylinder. For example, if the control handle is moved to the right, as is shown in dotted outline in FIG. 1, a fluid pressure rise occurs in the first fluid pathway 38. This tends to cause a fluid pressure rise in the first fluid supply pathway 91 through the fluid pathway 130 to the chamber 120 of the piston assembly 116. This results from the passageway 140 to the tank 28 having a smaller crossectional area than pathway 130 to cause the fluid to flow to the chamber 120.

In the embodiment of FIG. 2, the pressure rise causes the piston 117 to be displaced to the left as viewed on the drawing owing to fluid pressure acting on the piston in the first work portion 134 of the chamber 120. The result is to urge the ball 108 against its seat 112 with the rod 118, a position at which fluid is blocked from passing through its related chamber 104. A pressure rise or fluid signal can then be established in the first fluid pathway 38 to move the piston 52' in the slave cylinder 44 for controlling operation of the hydraulic cylinder 16. The ball 110 in the second check valve 102 remains unseated or, in some instances, will be drawn from the seat 114 of said check valve which maintains or establishes communication between the second fluid pathway 40 through the second fluid supply pathway 92 to the tank 28.

In the embodiment of FIG. 3, fluid pressure acts on both of the piston portions 117',117" in the work portion 138 to displace said pistons. Displacement of the pistons forcibly moves both portions 118',118" of the rod 118 against their respective balls 108,110. This results in seating of the balls on their related seats 112,114 at the first and second check valves 100,102. Fluid flow is thereby blocked from the first and second fluid pathways 38,40 through the check valves 100,102 and into the tank 28. A pressure rise or fluid signal can then also be established in said first fluid pathway to move the piston 52' in the slave cylinder 44.

It will seem, therefore, that while the master cylinder 42 is in the neutral position, both the first and second pathways 38,40 are open to the tank 28. The hydraulic circuit 32 thus automatically, controllably maintains synchronization of the slave and master cylinders when temperature variations in the circuit cause volume changes of the working fluid therein. In applications where the temperature changes may be significant, such as on a work vehicle, such automatic and controllable volume compensation substantially overcomes any problems associated with temperature variations and also frees the operator from monitoring the systems and allows him to attend to other duties.

Other aspects, objects, and advantages of this invention can be obtained from a study of the drawings, the disclosure and the appended claims.

I claim:

1. A hydraulic circuit (32), comprising:

a tank (28);

first, second, third and fourth pathways (38,40,84,86), said third and fourth fluid pathways (84,86) being positioned in fluid communication with said tank (28) and being positionable in fluid communication with said first and second fluid pathways, respectively;

first means (34) for receiving an input signal and controllably passing a predetermined fluid pressure signal through one of said fluid pathways (38,40) in response to said input signal;

second means (36) for receiving said fluid signal in said one of said fluid pathways (38,40) and automatically, controllably delivering an output signal corresponding to said input signal in response to said fluid pressure signal; and a control valve (76) having flow control means (98) including first and second check valves (100,102) each having a chamber (104,106), said flow control means automatically, controllably positioning said first and second fluid pathways (38,40) in fluid communication with said third and fourth fluid pathways (84,86), respectively, through the related one of said chambers (104,106) of said first and second check valves (100,102), respectively, in response to said first and second fluid pathways (38,40) being free from said fluid pressure signal and automatically, controllably blocking said second and fourth fluid pathways (40,86) from fluid communication one with the other through their related one of the chambers (104,106) in response to said fluid pressure signal passing in said second fluid pathway (40) and acting on said flow control means (98) and automatically, controllably blocking the first and third fluid pathways (38,84) from fluid communication one with the other through their related one of the chambers (106,104) in response to said fluid pressure signal passing in said first fluid pathway (38) and acting on said flow control means (98).

2. The hydraulic circuit (32), as set forth in claim 1, wherein said first means (34) is a master cylinder (42) and said second means (36) is a slave cylinder (44).

3. The hydraulic circuit (32), as set forth in claim 1, wherein said first and second fluid pathways (38,40) are in fluid communication with said control valve (76) and said third and fourth fluid pathways (84,86) are in fluid communication with said control valve (76) and said tank (28).

4. The hydraulic circuit (32), as set forth in claim 3, including first and second fluid supply pathways (91,92) and wherein said first and second fluid pathways (38,40) are in fluid communication with said control valve (76) through said first and second fluid supply pathways (91,92), respectively.

5. The hydraulic circuit (32), as set forth in claim 1, including a ball (108,110) positioned in each of said chambers (104,106) and movable between a position in its related one of the chambers (104,106) at which fluid is free to pass through said related one of the chambers (104,106) and another position at which fluid is blocked from passing through said related one of the chambers (104,106).

6. The hydraulic circuit (32), as set forth in claim 5, wherein said control valve (76) has a chamber (120), said first and second check valves (100,102) each have a seat (112,114), said balls (108,110) are seatable against their related, respective seats (112,114) and said flow control means (98) includes a piston assembly (116) positioned in said chamber (120) and movable to locations for seating said balls (108,110).

7. The hydraulic circuit (32), as set forth in claim 1, wherein the control valve (76) includes first and second pilot fluid pathways (130,132) in fluid communication with the chamber (12) and with the first and second fluid pathways (38,40), respectively.

* * * * *